US007895954B2

(12) United States Patent
Abel et al.

(10) Patent No.: US 7,895,954 B2
(45) Date of Patent: Mar. 1, 2011

(54) PORTABLE, NESTING VOTING BOOTH

(76) Inventors: Gary V. Abel, Ellicott City, MD (US); Joseph Wilson, Spencer, WV (US)

( * ) Notice: Subject to any disclaimer, the term of this patent is extended or adjusted under 35 U.S.C. 154(b) by 0 days.

(21) Appl. No.: 12/719,996

(22) Filed: Mar. 9, 2010

(65) Prior Publication Data

US 2010/0224105 A1 Sep. 9, 2010

Related U.S. Application Data

(60) Provisional application No. 61/209,644, filed on Mar. 9, 2009.

(51) Int. Cl.
*A47B 7/02* (2006.01)

(52) U.S. Cl. ..... 108/91

(58) Field of Classification Search ..... 108/91, 108/1; 312/196; 297/239, 448.1; 211/188, 211/126.7; 235/386, 51, 50 B, 54 A, 54 F, 235/55 A, 55 E; 280/33.998, 33.991, 47.4, 280/87.021, 47.35

See application file for complete search history.

(56) References Cited

U.S. PATENT DOCUMENTS 1,941,340 A * 12/1933 Dellert ..... 297/239
2,479,530 A 8/1949 Watson
2,762,669 A * 9/1956 Watson ..... 108/91
2,794,695 A * 6/1957 Heal ..... 108/146
2,992,833 A * 7/1961 Hoedinghaus et al. ..... 280/641
3,115,850 A 12/1963 Sloan
3,326,147 A 6/1967 Toney
3,351,402 A * 11/1967 Barecki et al. ..... 312/233
3,629,960 A * 12/1971 Roush ..... 434/429
3,858,528 A 1/1975 Petersen
4,067,606 A 1/1978 Desmoulins nee Fouchereau et al.
D273,337 S * 4/1984 Semerjian et al. ..... D34/21
4,445,731 A 5/1984 Ahmann
4,484,755 A 11/1984 Houston
4,484,787 A 11/1984 Stephens
4,529,246 A * 7/1985 Leib ..... 297/285
4,854,652 A 8/1989 Ahmann
5,613,448 A 3/1997 Petty
5,666,765 A 9/1997 Sarner et al.
6,827,262 B2 12/2004 McClure et al.
7,451,918 B2 11/2008 Vogt

* cited by examiner

*Primary Examiner* — Janet M Wilkens
(74) *Attorney, Agent, or Firm* — Ober/Kaler; Royal W. Craig

(57) ABSTRACT

A voting booth that is easily transported between a polling-facility and a storage facility, easy to set up, and efficiently stored with other voting booths when not in use. The voting booth comprises an inclined private semi-enclosure and a leg assembly in a nesting configuration. The leg assembly optionally includes a plurality of casters. The voting booth components are configured to allow modular grouping and nesting with voting booths of like construction. The voting booth is light-weight and has a high degree of mobility. The nesting ability provides for efficient storage by minimizing the space needed to store multiple voting booths.

13 Claims, 8 Drawing Sheets

PORTABLE, NESTING VOTING BOOTH

CROSS-REFERENCE TO RELATED APPLICATION

The present application derives priority from U.S. provisional application No. 61/209,644 filed on Mar. 9, 2009, which is incorporated herein by reference.

BACKGROUND OF THE INVENTION

1. Field of the Invention

The present invention relates to voting booths and, in particular, to portable, nesting voting booths that can be easily nested for minimal setup, convenient transport between a polling facility and a storage facility, and efficient space utilization when not in use, and that can be positioned in modular grouping with other booths.

2. Description of the Background

Voting is one of the most fundamental acts of a democratic society, and the privacy of the voters is paramount for several reasons. First of all, privacy avoids post-election partiality by the winning government. Secondly, privacy ensures that voters are not influenced by the popular vote. For these reasons, there are laws to ensure voter privacy, and voting booths must comply with these laws.

A voting booth provides an individual voter with an enclosed area for casting a vote, using a ballot, mechanical, or electronic voting system, at a polling-place facility. This ensures voter anonymity. Voting booths can be permanent against-the-wall enclosures, each having a door or curtain. However, given the infrequent nature of elections, polling places are seldom single purpose facilities. Most polling-places are temporary facilities—often times schools, halls, and local government offices—that are used for voting on a temporary basis because elections only occur periodically over a short time period. Permanent voting booth installations are not possible in this case, and instead, it is necessary to store and transport multiple voting booths between a storage location (during non-election periods) and the polling-place (during elections). Consequently, conventional voting booths are typically free-standing temporary (knock-down) structures having a shelf and privacy panels that obstruct the view of others in the vicinity.

During elections, a polling-place facility will have multiple voting booths to accommodate numerous voters simultaneously. It is a daunting task for local election officials to deploy these voting booths and other voting equipment at every polling-place facility. The voting booths must be transported to the polling-place facility, and once at the polling-place facility, the booths must be set up. Conventional portable voting booths, for example, the booth disclosed in U.S. Pat. No. 6,827,262 to McClure, requires extensive set up. The booth components must first be unpacked from its closed position by unfolding the bi-fold case. The legs must be assembled and attached to the case to elevate the voting surface, and once assembled, the booth must be placed in position at the polling-place facility without accidently dislodging any of the assembled components. The process is reversed within days. Additionally any part that is separated during assembly may become lost. Possibility of lost parts requires that that an inventory of parts be made both before and after deployment.

Given such conditions of use, voting booths must be extremely durable to withstand harsh handling by election workers and some voters. Indeed, modern voting booths must be strong enough to support heavy voting machines. At the same time, voting booths must be as versatile as possible, maintaining portability and functionality in a self-contained, easy to set up, and lightweight form factor. Therefore, any design that makes storage more compact, transport quicker, and set up easier without sacrificing durability would be greatly advantageous.

There have been previous efforts in this regard. For example, U.S. Pat. No. 4,484,787 to Stephens relates to a disposable foldable combination voting booth and speaker's lectern. The reference, however, does not disclose any degree of durability. There are also suitcase-type voting booths that collapse flat into a suitcase form factor. However, fully collapsible voting booths tend to compromise durability and complicate the setup/take down process. Additionally, the number of individual and separate parts leads to the potential of accidental loss of the needed parts. The concept of nesting voting booths that can be consolidated into a compact grouping has not been previously attempted. Nesting would allow the voting booths to remain substantially assembled (maintaining durability and ease of setup), yet also facilitate convenient transport of multiple booths between a polling facility and a storage facility in a compact grouping and more efficient space utilization when not in use. Nestability is known in other contexts. Food containers and paper plates are nestable but have an inherently simple structure that allows it. More complex three-dimensional products must be carefully designed to nest properly, and to nest fully to conserve maximum space. This can become a daunting effort, and yet there have been efforts to nest more complex articles such as furniture. Stacking chairs are known, and U.S. Pat. No. 5,613,448 to Petty discloses a nesting desk with an inclined desktop. However, this reference is not a portable voting booth and does not require privacy panels or a long leg structure. If privacy panels were added to the desk, the desk would no longer nest.

In this regard there is a need for a durable voting booth that is portable, has a high degree mobility, is easy to set up, and is lightweight. There is also a need for a nesting voting booth that allows many such booths to be nested and transported, thereby minimizing storage space and effort.

SUMMARY OF THE INVENTION

According to the present invention, a portable voting booth is provided that has the capability of nesting with other voting booths. The voting booth is easily transported between a polling-place facility and a storage facility, easily to set up at the polling-place facility, and is efficiently stored with other voting booths in a compact grouped configuration when not in use. The voting booth is a free-standing structure comprising a private semi-enclosure having an inclined working surface surrounded at least one privacy panel and supported atop a leg assembly. The private semi-enclosure is configured with a thin, flat working surface that is downwardly inclined from back to front. In an embodiment, the overall shape of the working surface is polygonal with a front edge that is wider than the back. With this configuration, the side edges may run straight from front-to-back, joining the front edge at acute angles, or alternatively the side edges may be segmented into a plurality of obtusely-angled portions that running from front-to-back. In an alternative embodiment, the overall shape of the working surface is curvilinear, for example, a circular segment or a parabolic segment, with secant or chord forming the front edge. The semi-enclosure is bounded on at least one side by an upwardly extending privacy panel, and is more preferably bounded along both sides as well as the back of the working surface leaving an open front and top.

During voting use, the working surface of the private semi-enclosure supports a paper ballot or electronic voting machine in front of the voter at an optimal height. The leg assembly is constructed of a tubular frame that defines a broad floor base for good stability, a vertical spacer for elevating the semi-enclosure to approximately waist-height, and a platform support for attaching the semi-enclosure to the leg assembly. The platform support may be slightly inclined relative to the floor base. The particular shapes and angulation of the components of both the leg assembly and private semi-enclosure are designed to allow maximum nesting of multiple booths and highest-possible-density stacking thereof. The particular shapes and angulation of the components also facilitate manual nesting, effectively guiding the booths together into their nested configuration. Moreover, the particular placement, shape, and angulation of the vertical spacer still allows for slight manufacturing alterations to accommodate voters in wheel chairs. Optionally, mounted beneath the leg assembly is a plurality of casters for increased mobility of voting booths both individually and in a nested configuration.

The entire voting booth, both the private semi-enclosure and leg assembly, has a nesting configuration in which the acutely-angled working surface and privacy panels allows multiple voting booths to be easily positioned into a straight-line or arcuate modular grouping with other booths for efficient use of polling-place facility and for maximum voter privacy and comfort. Additionally, the open-faced, open-topped and acutely-angled semi-enclosure in combination with angular leg assembly allows for nesting of a voting booth into another voting booth of like construction—the back-side of a voting booth can be inserted into the front of another voting booth for a loose engagement. The structural configuration guides the nesting to a tightly compact configuration, which allows for maximum compactness, and efficient storage or transport of multiple booths at one time. The voting booth's scale can be changed to accommodate any voting system, including ballot, mechanical, and electronic systems. To increase mobility, the voting booth is structurally designed to minimize weight.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION

Figure 1:
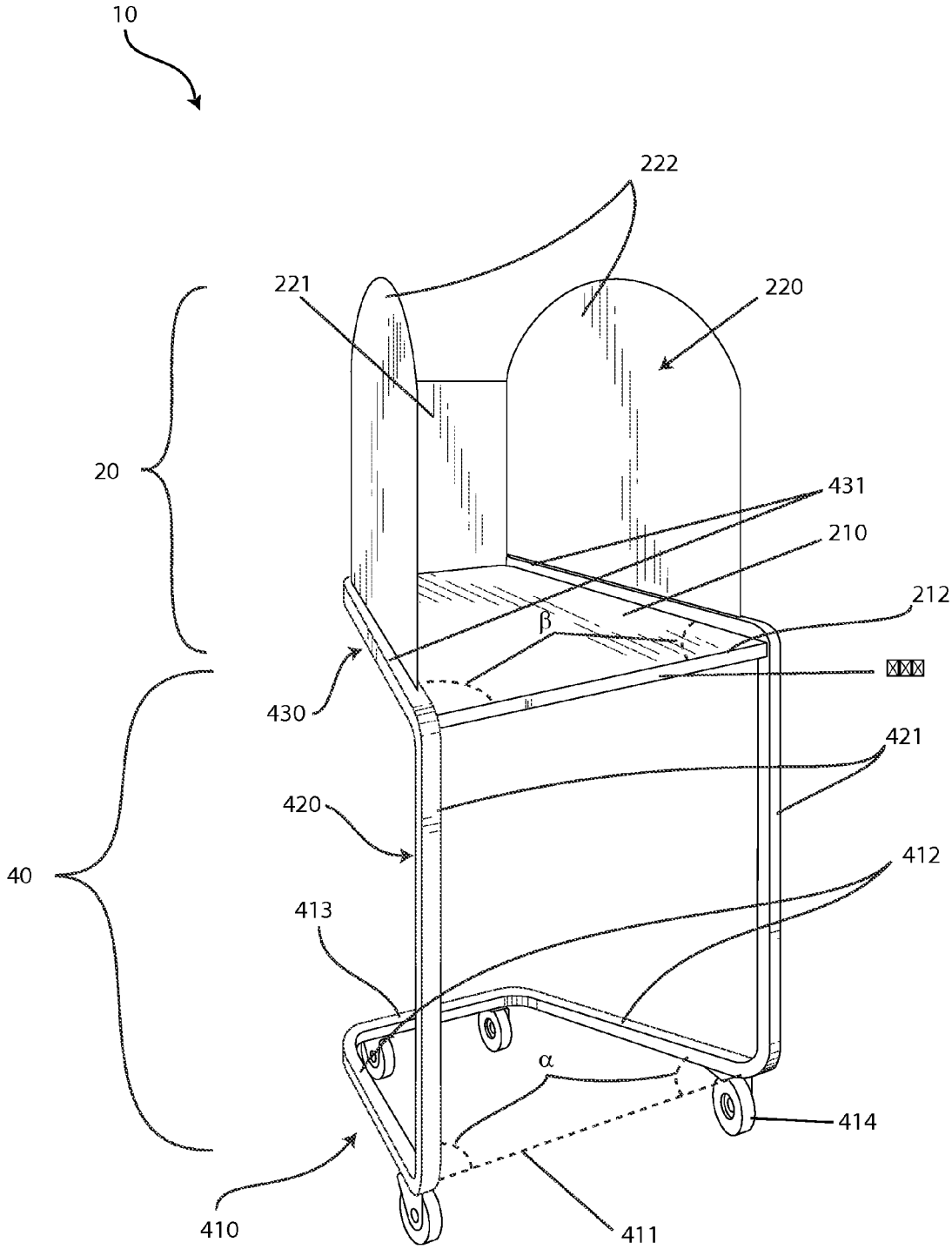
FIG. 1 is a perspective view of a portable, nesting voting booth according to an embodiment of the present invention.
Figure 2:
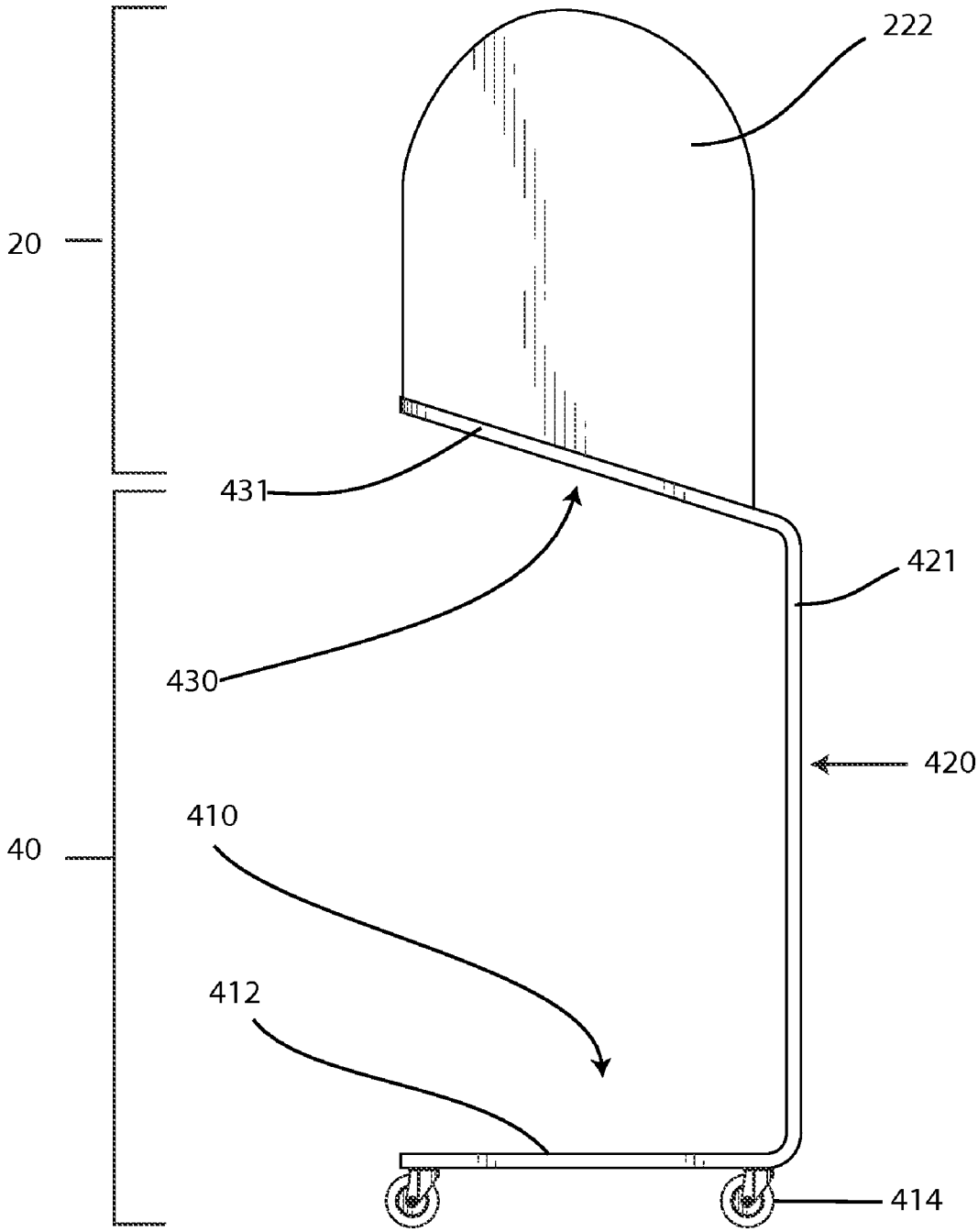
FIG. 2 is a side view of the voting booth as in FIG. 1.
Figure 3:
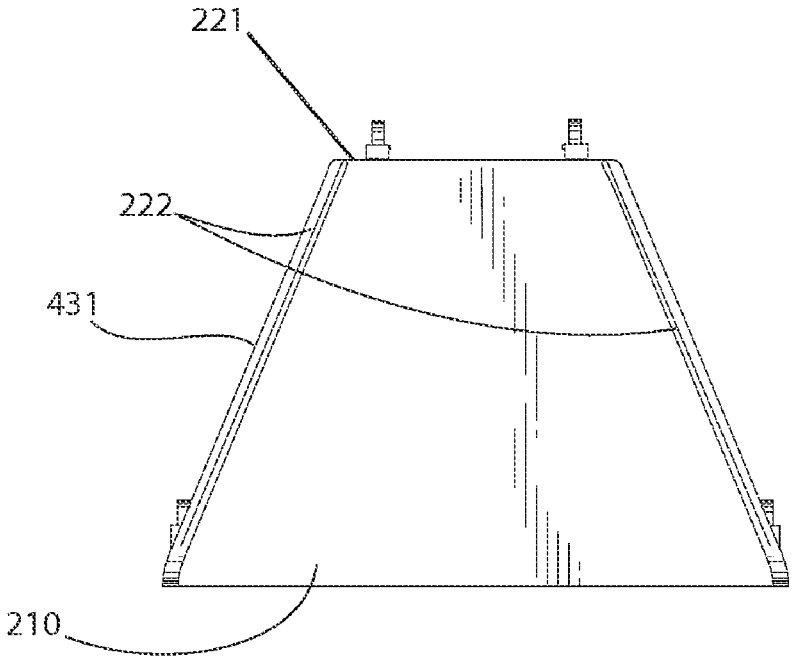
FIG. 3 is a top view of the voting booth as in FIGS. 1-3.
Figure 4:
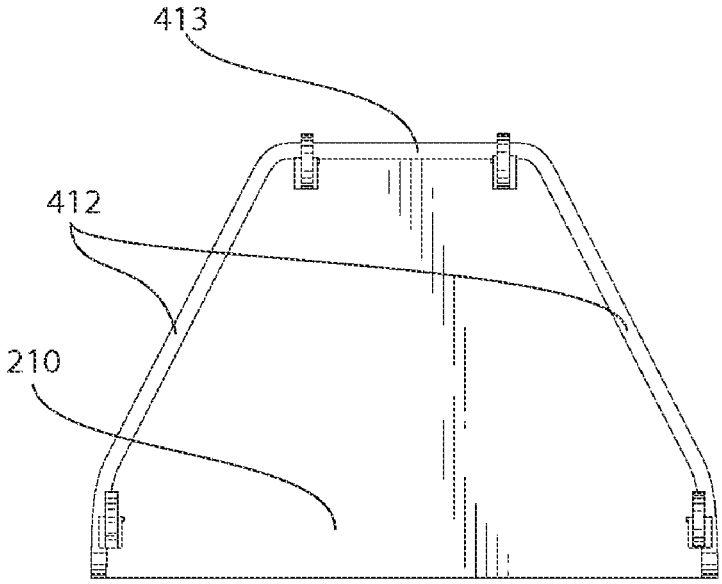
FIG. 4 is a bottom view of the voting booth as in FIGS. 1-4.
Figure 5:
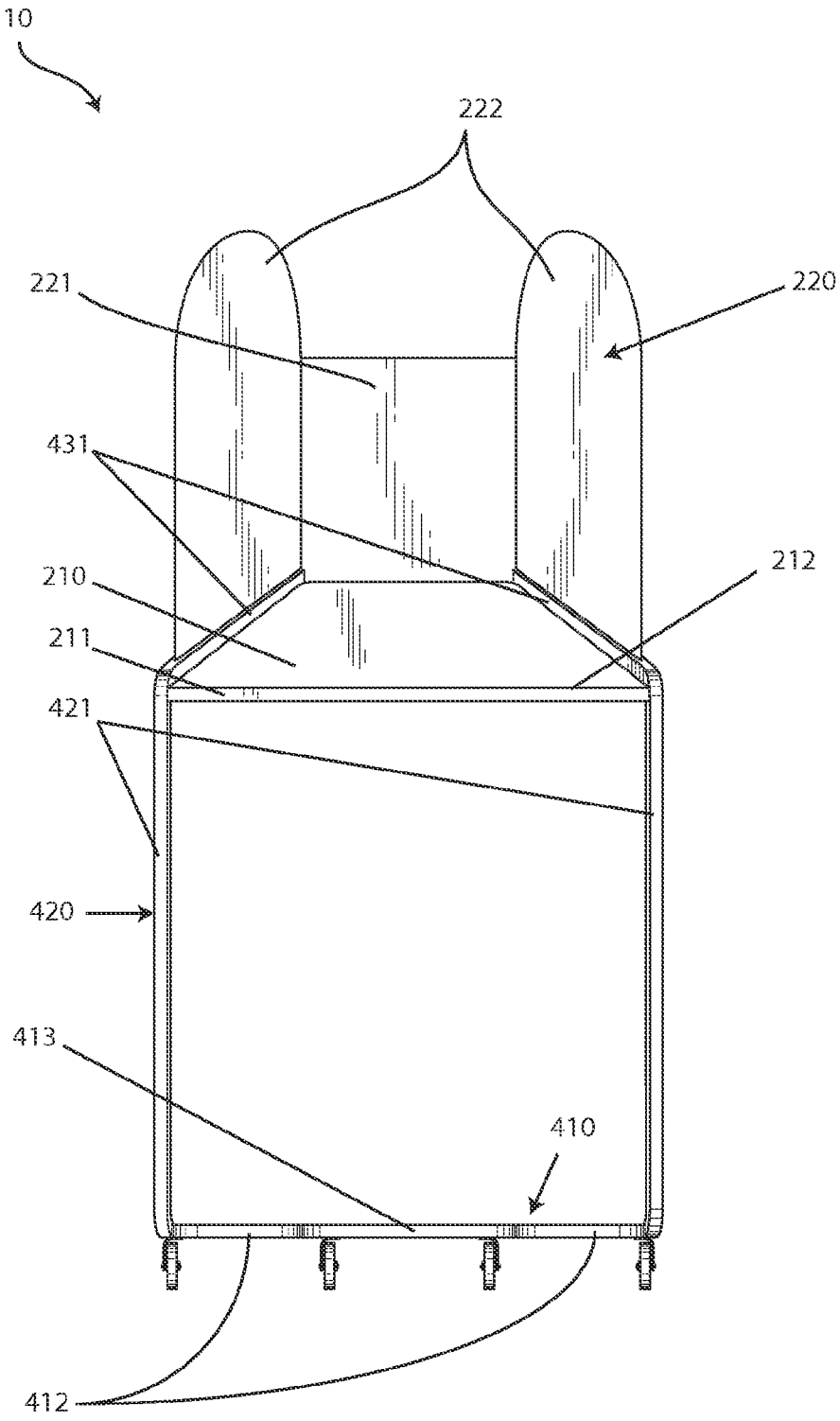
FIG. 5 is a front view of the voting booth as in FIGS. 1-5.
Figure 6:
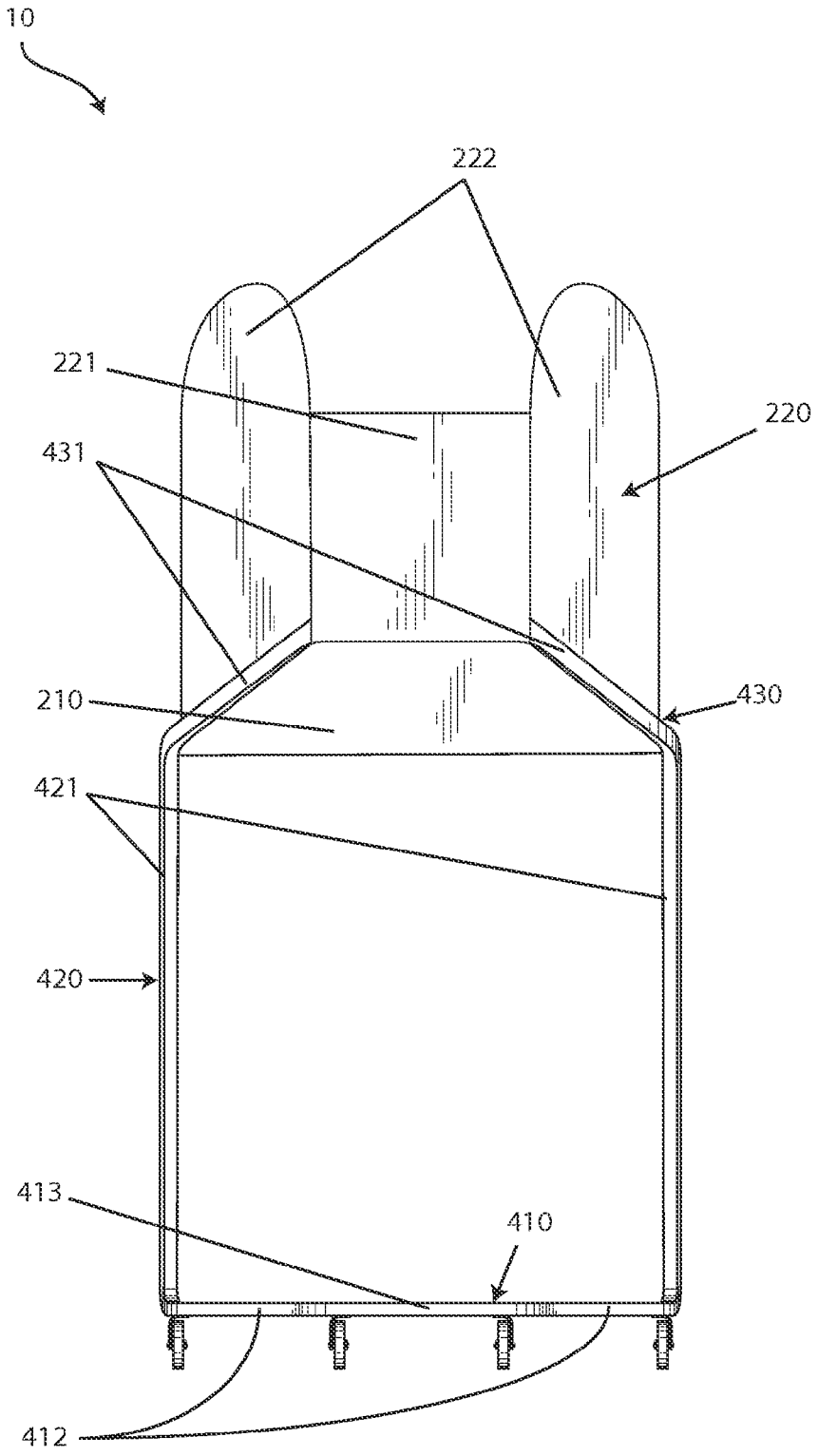
FIG. 6 is a back view of the voting booth as in FIGS. 1-6.

FIG. 1 is a perspective view of a portable, nesting voting booth 10 according to an embodiment of the present invention. The voting booth 10 is a free-standing structure that is easily transported between a polling-place facility and a storage facility, easily set up at the polling-place facility, and efficiently stored with other voting booths in a compact nested grouping when not in use. The voting booth 10 generally comprises an elevated private semi-enclosure 20 atop a freestanding leg assembly 40 in a rigid (non-collapsing) yet compliant (shock-absorbing) configuration that allows the voting booth to nest with other voting booths of similar construction. The semi-enclosure 20 sits atop the leg assembly 40 and forms an open-topped, open-faced, four-sided (in the illustrated embodiment) space, bounded by a downwardly sloping working surface 210 and privacy panels 220, preferably a rear panel 221 and two opposing side panels 222.

With collective reference to FIGS. 1-7, the leg assembly 40 comprises a floor base 410 and a vertical spacer 420. The floor base 410 can be aligned in any configuration that provides a stable foundation yet still allows the voting booth 10 to nest with other voting booths of similar construction. A horizontally-planar tubular member running front-to-back along a polygonal or concave curvilinear incurvature is preferred. Suitable nesting alignments include, but are not limited to, any open-path or unbounded configuration with an open end 411 and stabilizing floor base 410 lengths that run front-to-back at effective acute angles $\alpha$ with respect to open end 411. The side lengths may run straight from front-to-back, intersecting the open end 411 at acute angles $\alpha$, or alternatively the side lengths may run along a concave incurvature or be segmented into a plurality of obtusely-angled portions that run from front-to-back along a partial cyclic polygon.

In the illustrated embodiment, the floor base 410 is substantially U-shaped open at the front and (if bounded at open end 411) defines an interior isosceles trapezoid. The three conjoined lengths include opposing forwardly-flared side lengths 412 and lower rear length 413 that are arrayed along the legs and minor base of an isosceles trapezoid. The interior angles $\alpha$ between the open end 411 and side lengths 412 are acute. However, the floor base length(s) may be arrayed in other configurations, for example, along only the legs of a trapezoid, two sides of a triangle, or along the arc of a circle, ellipse, oval, parabola, or similar incurvature. The floor base length(s) may also be arrayed along a combination of shapes, for example, along the legs of an isosceles trapezoid front section then arching along a circular segment back section, or along opposing sides of a rectangular front section to the legs and/or minor base of a trapezoidal back section, both of which form effective acute interior angles $\alpha$ between the open end 411 and the arc of the circular segment or the legs of the trapezoid, respectively. Having the front wider than back, the open ended or unbounded configuration allows for nesting by accepting the floor base of another voting booth of similar construction.

Optionally, a plurality of casters 414 are mounted beneath the floor base 410 for mobility. In the illustrated embodiment, the casters 414 are mounted at all four corners of the polygonal floor base 410. The casters 414 may be of any type, for example, stationary or swivel stem casters, and of any size, for example, 3" casters, and the casters may have optional brake-lock capability.

Figure 7:
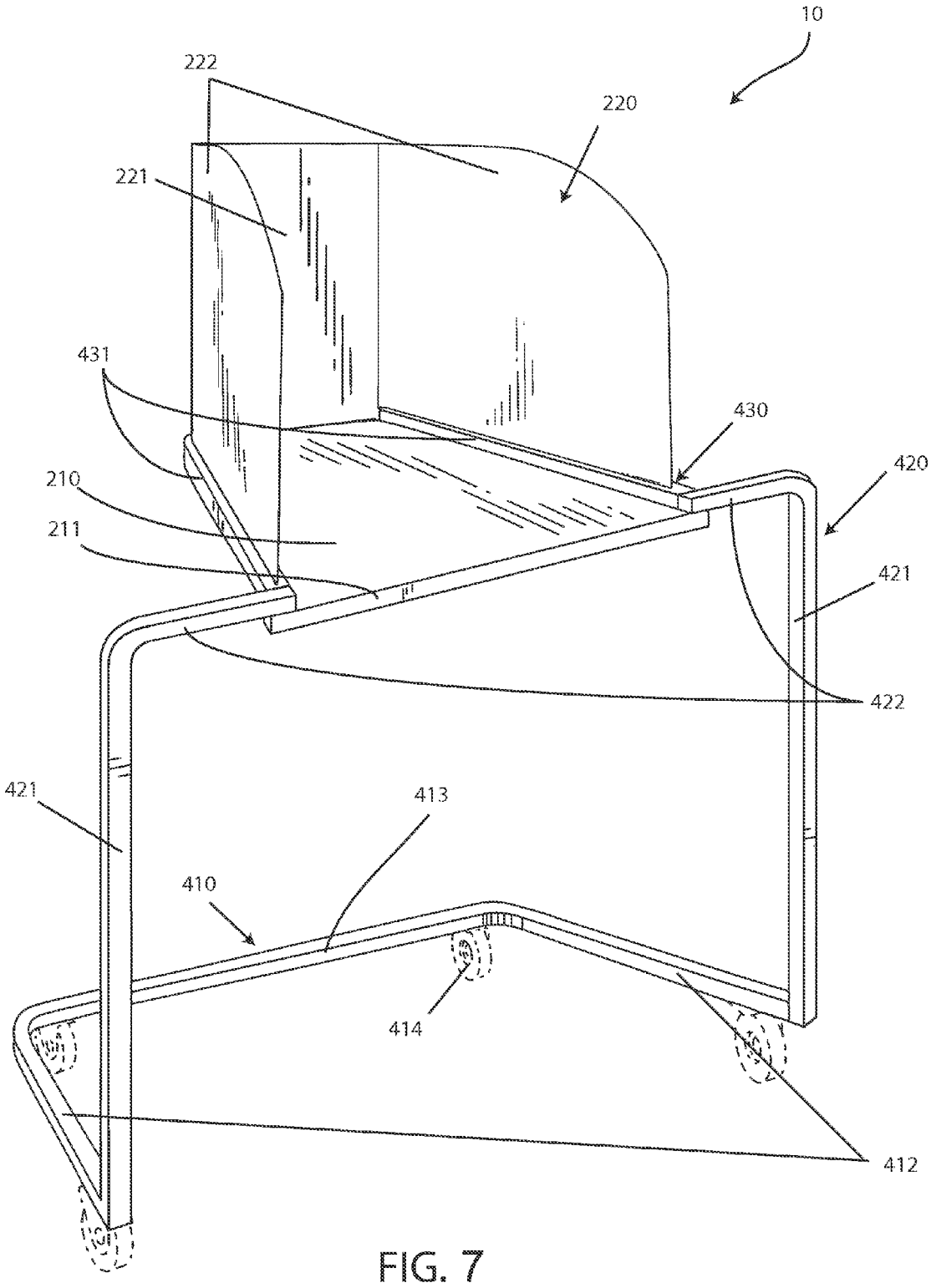
FIG. 7 is a perspective view of a portable, nesting voting booth according to an alternative embodiment for use with voters in wheel chairs.

The leg assembly 40 further comprises a vertical spacer 420 that extends upward from the floor base 410 to elevate the private semi-enclosure 20. The vertical spacer 420 comprises one or more upwardly-extending members extending from any point(s) on the floor base 410 to any point(s) on the private semi-enclosure 20, excluding the rearmost edge or point of the shelf, to facilitate nesting. Preferably, the upwardly-extending members of the vertical spacer 420 are joined in close proximity to the front of the shelf 20 because this maximizes nesting capability and group compactness. In the illustrated embodiment, the vertical spacer 420 is a pair of vertical struts 421 that extend vertically from the lower side lengths 412. Preferably, the vertical spacer 420 elevates the working surface 210 to approximately waist-height for a six-foot person—a height that is most convenient to a standing voter or to table height, which would be most convenient for a seated person possibly in a wheelchair. In an alternative embodiment, the vertical spacer 420 may be telescoping or adjustable. For example, vertical struts 421 can be equipped with a detent-pin interlock so that the height may be adjusted to accommodate seated voters who could be in a wheel chairs. In another embodiment, as illustrated in FIG. 7, the vertical spacer 420 can be a fixed shorter length. In this embodiment, the floor base 410 is arrayed in a broader configuration (preferably wider than the private semi-enclosure 20). The broader configuration increases the width between vertical struts 421 to accommodate a wheel chair, requiring additional lengths 422 to connect the vertical struts 421 to the private semi-enclosure 20 and a lengthening of the lower rear length 413.

The leg assembly 40 may further comprise a top platform support section 430 for attaching the private semi-enclosure 20 to the leg assembly 40. The platform support section 430 comprises one or more lengths that are arrayed around the periphery of the private semi-enclosure 20. Alternatively, private semi-enclosure 20 is attached directly to the vertical spacer 420 without the platform support section 430.

The leg assembly 40 comprises any rigid material, for example, aluminum, steel, composite, or plastic tubing. In an embodiment, the leg assembly 40 is formed by 1", 16 gauge structural steel square tubing. The leg assembly 40 may be formed from one contiguous piece of tubing bent at the desired locations or from separate, individual members fastened or welded together. The leg assembly 40 has a baked enamel powder coated finish (nominal 3 mils) with zinc oxide primer wash.

As stated previously, the top platform support section 430 is slightly inclined relative to the floor base 41—the top-side members 431 are inclined downward. The angle of incline may range from between 5-45 degrees downward from horizontal, and is preferably about 10 degrees. The top-side members 431 also extend backwards at converging angles along the periphery of the private semi-enclosure 20. The top-side members 431 are fixedly attached to the corresponding sides of the shelf 20 and privacy panels 220.

The private semi-enclosure 20 is fixedly attached to the leg assembly 40. The private semi-enclosure 20 comprises a working surface 210. The working surface 210 is a thin, flat surface affixed atop leg assembly 40 so as to be downwardly inclined from back to front. The working surface 210 can by any of a variety of shapes that allow the voting booth 10 to nest with other voting booths when privacy panels 220 are attached or set-up. In an embodiment, the working surface can be any polygonal shape with a front edge that is wider than the back. The side edges may run straight from front-to-back, joining the front edge at acute angles β, for example, the major base and legs of a quadrilateral-trapezoid. Alternatively, the side edges may be segmented into a plurality of obtusely-angled segments running from front-to-back. For example, the shape of the working surface 210 may be hexagonal with parallel front and back edges, and side edges which extend for a short length at right angles from the front edge, but then abruptly angle inward at one or more obtuse angles toward the back edge. In any such case, the front edge forms effective acute angles with the normalized side edges despite their one or more intermediate obtuse angles. Other suitable shapes for the working surface 210 may include, but are not limited to, other polygonal trapezoids, triangles, pentagons, hexagons, octagons, etc, so long as the front edge is wider than the back, and the normalized side edges form effective acute interior angles β with the front edge.

The working surface 210 may further comprise downwardly-angled edges 211 butt-welded at the corners to increase rigidity. The working surface 210 is inclined to provide an ergonomically sloped writing surface and to facilitate nesting. The working surface 210 is appropriately sized to accommodate a range of balloting systems—including optically scanned paper ballots, mechanical ballots, and electronic ballot machines or other electronic systems. Preferably, the working surface 210 for a paper ballot will accommodate a twenty inch ballot in both landscape and portrait positions. If a machine or electronic voting system is being used, an attachment mechanism may be attached to the working surface 210 to secure the voting device. For example, such attachment mechanisms may include straps, brackets, fasteners, adhesives, etc. Preferably, the front edge of the working surface 210 is bent upward then downward to create a protruding upward flange 212. Flange 212 prevents articles from sliding off the working surface 210 and also increases strength by preventing buckling. In an embodiment, the private semi-enclosure 20 is attached to the leg assembly 40 by attaching the downwardly-angled edges 211 of shelf 20 at the rear and sides to the leg assembly 40 by fastening or welding. If fasteners are used, the fasteners penetrate first through the downwardly-angled edges 211 of shelf 20 and into the leg assembly 40 from beneath the shelf to minimize outward protrusions.

The private semi-enclosure 20 further comprises at least one privacy panel 220, and in the illustrated embodiment comprises two opposing side panels 222 and a rear panel 221. If the voting booths 10 are arranged side-by-side, only one side panel is necessary but two provide more flexibility in use. Privacy panels 220 extend vertically along the outer periphery of the working surface 210, leaving a voter access to the shelf while also providing voter privacy. The privacy panels 220 can be of any height, size, and shape so long as they sufficiently obstruct the view of other standing voters. Preferably privacy panels 220 extend to about shoulder height of a standing 6 foot man (about 1½ to 2' each in height from the working surface 210). The privacy panels 220 may extend from the platform support 430 or from the working surface 210 of the private semi-enclosure 20.

The private semi-enclosure 20, including working surface 210 and privacy panels 220 comprises any thin rigid material, for example, steel or aluminum sheeting or plating, plastic, composite material, laminated wood, or particle board. For aesthetics, durability and weight, coated (painted) 14 gauge steel sheet is preferred.

In the illustrated embodiment, privacy panels 220 comprise a rear panel 221 and opposing outwardly flared side panels 222. The rear panel 221 is fixedly attached inside the rear length of platform support 430 while the side panels 222 are welded directly along the top surface of the outwardly flared and downwardly-sloping side lengths 431 of platform support 430. Alternatively, the privacy panels 220 may be fixedly attached by fastening bottom flanges on the privacy panels to the leg assembly 40 and/or working surface 210 of the shelf 20. The rear panel 221 is also fixedly attached to the adjacent privacy panels 222, thus acting as a shear wall that resists lateral side-to-side loads placed on the voting booth 10. The combination of the fixed rear panel 221 and the shelf's down-ward edge 211 eliminates the need for a horizontal support spanning the privacy panels 220, thus minimizing weight. The rear panel 221 may be formed separately from the opposing outwardly-flared side panels 222 and attached thereto by welding or the like, or alternatively, the rear panel 221 and opposing outwardly-flared side panels 222 may be formed from a single-patterned sheet of steel and bent into the illustrated configuration.

Although durability is paramount and fixed rigid panels 220 are preferred, one skilled in the art should understand that the privacy panels 30 may alternatively be removably attached, for example, using detent slots, hook and eye (VELCRO™ style) fasteners, magnets on metal constructions, or pivotally attached, for example, using hinges, to provide a knock-down feature to further conserve space when not in use.

In the illustrated embodiment, when viewed from above, the voting booth's outer periphery has a trapezoidal shape as the private semi-enclosure 20 is an isosceles trapezoid and platform support 430 and floor base 410 are arrayed along the legs of the isosceles trapezoid, diverging from back to front—forming effective acute angles between the front edge and the sides. The resulting open-topped, open-faced space of the private semi-enclosure 20 in combination with the inclined working surface 210, the vertical spacer 420 not attaching to the rearmost edge of the shelf 20, and the nesting configuration of the leg assembly 40, facilitates and indeed encourages nesting. The voting booths can be nested in an upright configuration by sliding or wheeling them together, or a voting booth can be laid on its back (on a hand cart) and other voting booths can be dropped therein, beginning with the rear privacy panel of another voting booth. The trapezoidal shape, which has a front that forms effective acute interior angles with the adjacent sides, helps to register each successive voting booth and keeps adjacent units in tight nested registration. Moreover, once nested, the ¾-1" lengthwise offset between adjacent units allows the leg assemblies 40 to simply be dropped over each other (since they are likewise offset and do not obstruct each other). The front-to-back tubular configuration of the leg assembly 40 also facilitates nesting since the legs of adjacent units work against the inclined shelf 20 to further lock nested units in position by gravity. This configuration provides excellent stability and durability, allows nesting of multiple booths and high-density stacking thereof, gives multiple setup options, and allows for easy transport of multiple voting booths.

The ability to nest with other voting booths provides for efficient storage by minimizing the surface area needed for storage, and the capacity for self-guided nesting avoids damage, ensures maximum group compactness, and simplifies the process.

Figure 9:
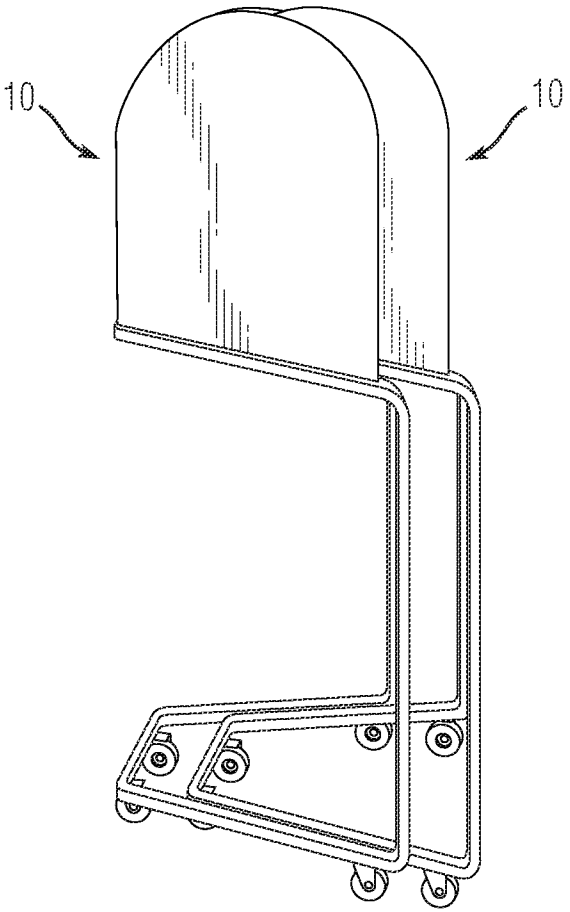
FIG. 9 is a side view of two voting booths nested together.
Figure 8:
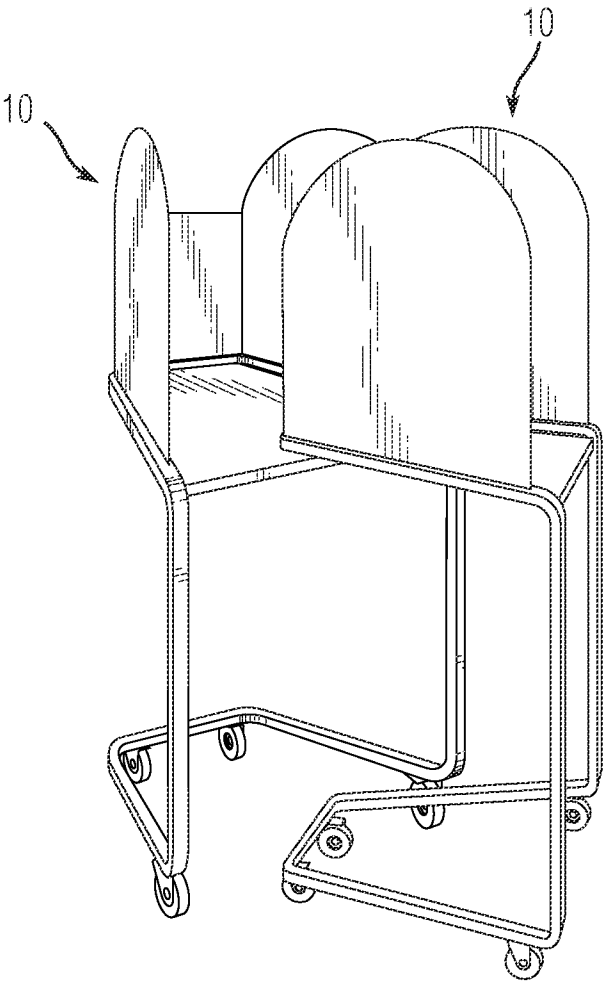
FIG. 8 is a perspective view of two voting booths at an initial stage of being nested.

FIGS. 8-9 illustrate the nesting engagement of voting booths 10 according to the present invention. The incline of private semi-enclosure 20 and the nesting periphery having a front forming acute interior angles with the adjacent sides (trapezoidal in the illustrated embodiment) allow unimpeded insertion of the leg assembly 40 and private semi-enclosure 20, of one voting booth within the leg assembly 40 and private semi-enclosure 20 of another voting booth. This diverging configuration allows another voting booth to be positioned and easily guided into a full nesting position with little precision. Given the overall dimensions of 28" width×21" length×60" height of the presently-preferred embodiment, six hundred voting booths can be stored in a 4'×100' area. Each booth occupies a 0.67 square foot area and weighs only 48 lbs. Approximately 83% of the bulk area of each unit is eliminated by nesting.

Figure 11:
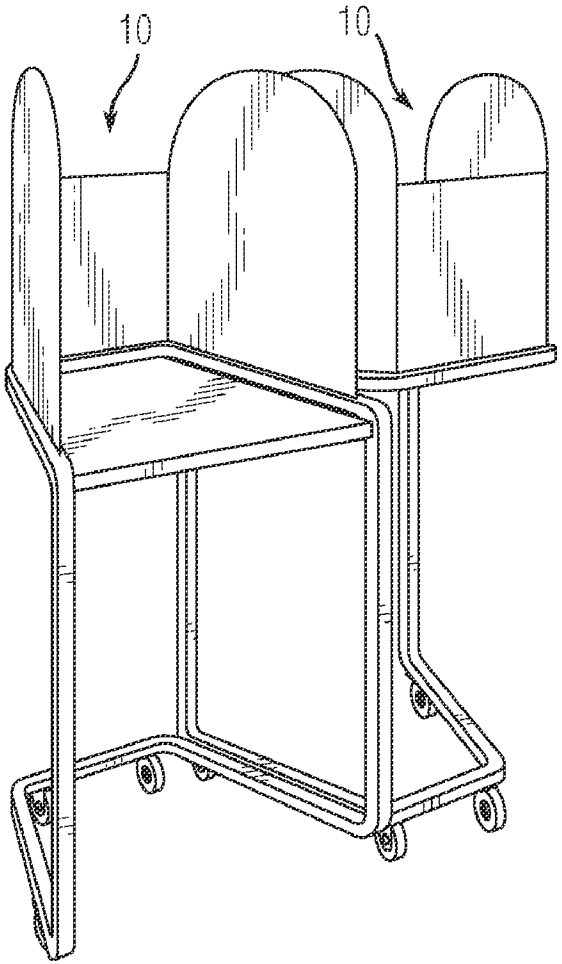
FIG. 11 is a perspective view of an alternating, straight-line modular grouping.
Figure 10:
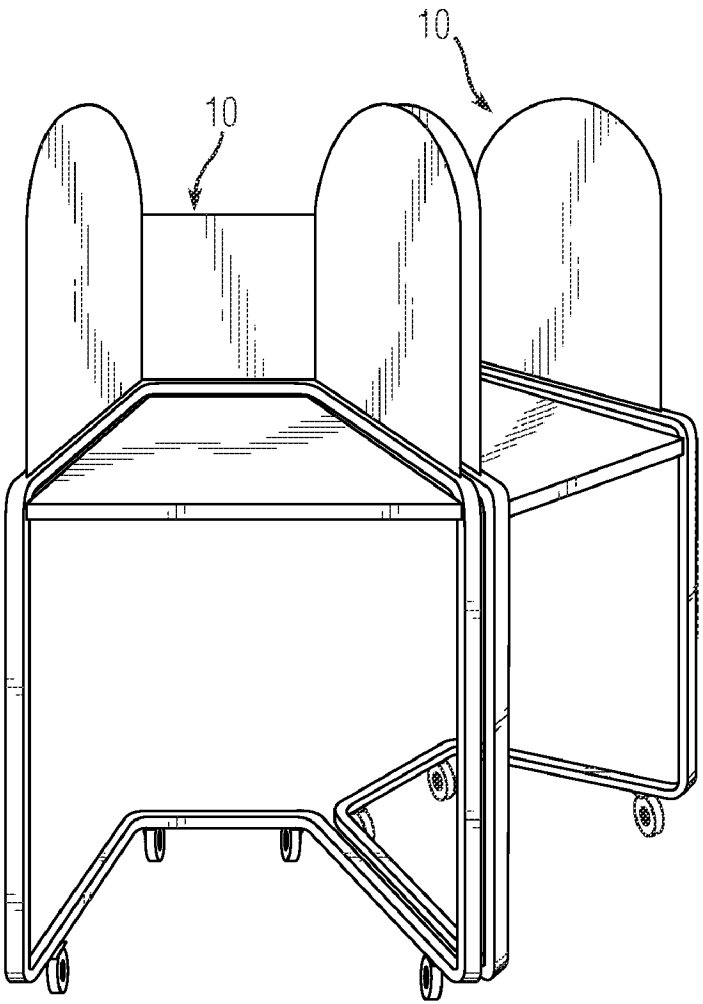
FIG. 10 is a perspective view of an arcuate modular grouping.

This nesting configuration, and specifically the trapezoidal shape, allows similarly constructed voting booths 10 to be positioned in modular groups for use during voting. Modular groupings allow the voting booths to be positioned in a manner that maximizes polling-place facility space during voting, while also maximizing voter privacy and comfort. The trapezoidal shape allows an arcuate modular grouping of outwardly facing voting booths 10, as illustrated in FIG. 10, or a straight-line modular grouping of alternate facing voting booths as illustrated in FIG. 11.

In addition to maximizing storage space and allowing modular groupings, the voting booth nesting ability in combination with the plurality of casters 414 enables transport of multiple voting booths at a time. Multiple voting booths 10 can be nested to together, forming a line of nested booths. And the plurality of casters 414 enables a single person to easily push the entire line of booths.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singularly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A portable, nesting voting booth comprising:

an open-topped, open-faced semi-enclosure defined by a trapezoidal working surface having a peripheral front edge, a rear edge parallel to said front edge, and opposing side edges, said working surface being inclined downward from its rear edge to its front edge, and at least one privacy panel partially surrounding the peripheral rear edge and side edges of the working surface; and a tubular leg assembly fixedly attached to the working surface, the leg assembly having a horizontal floor base partially circumscribing a trapezoidal shape with opposing legs extending along non-parallel sides and joined at obtuse angles along a minor base, unbounded along a major base of said trapezoidal shape, said tubular leg assembly further comprising a vertical spacer extending upwardly from said floor base;

a platform support comprising a pair of opposing members extending adjacent the opposing side edges of said working surface and inclined in conformance therewith for attaching the working surface to the leg assembly;

said semi-enclosure being adapted for nesting like semi-enclosures, said leg assembly being adapted for nesting like leg assemblies, the semi-enclosure and leg assembly combined allowing said portable, nesting voting booth to horizontally nest with other voting booths of similar construction.

2. The portable, nesting voting booth according to claim 1, wherein the inclined working surface front edge forms effective acute angles with both of the side edges.

3. The portable, nesting voting booth according to claim 2, wherein the floor base comprises a support member extending along said minor base of said trapezoidal shape.

4. The portable, modular voting booth according to claim 3, wherein said at least one privacy panel comprises three privacy panels, two of said privacy panels being attached to said platform support.

5. The portable, nesting voting booth according to claim 4, wherein said three privacy panels are arrayed along the rear edge, and opposing sides of said trapezoidal working surface.

6. The portable, nesting voting booth according to claim 4, wherein the three privacy panels are removably attachable.

7. The portable, nesting voting booth according to claim 1, wherein the leg assembly further comprises a plurality of casters mounted underneath.

8. The portable, nesting voting booth according to claim 1, wherein the floor base defines a trapezoidal shape with a major base, minor base and non-parallel sides, and said floor base comprises a single member formed along an unbounded curvilinear path extending along the non-parallel sides and minor base of said trapezoidal shape.

9. The portable, nesting voting booth according to claim 1, wherein the vertical spacer comprises a single member extending from the floor base.

10. The portable, nesting voting booth according to claim 1, wherein the vertical spacer comprises a pair of members extending from the floor base.

11. The portable, nesting voting booth according to claim 1, wherein the working surface further comprises an integral flange attached along the inclined working surface front edge.

12. The portable, nesting voting booth according to claim 1, wherein the leg assembly is formed from one contiguous piece of tubing.

13. The portable, nesting voting booth according to claim 1, wherein the floor base is configured to allow a voter in a wheel chair to access the working surface, and the vertical spacer is sized to support the shelf at a height that accommodates the voter in a wheel chair.

* * * * *